US005199421A

United States Patent [19]

Figgiani et al.

[11] Patent Number: 5,199,421

[45] Date of Patent: Apr. 6, 1993

[54] SWIM MASK AND SNORKEL APPARATUS

[76] Inventors: Gerard G. Figgiani; Angel Starling, both of 45-38 220 Place #2, Bayside, N.Y. 11361

[21] Appl. No.: 791,353

[22] Filed: Nov. 14, 1991

[51] Int. Cl.[5] ..... B63C 11/16; B63C 11/02; A62B 18/08

[52] U.S. Cl. ..... 128/201.11; 128/201.26; 128/201.27

[58] Field of Search ..... 128/201.11, 201.26, 128/201.27, 200.24, 207.14, 207.17

[56] References Cited

U.S. PATENT DOCUMENTS 690,663 1/1902 Pratt ..... 128/201.11
3,721,236 3/1973 Bardehle ..... 128/201.11

FOREIGN PATENT DOCUMENTS 780018 4/1935 France ..... 128/201.11

*Primary Examiner*—Edgar S. Burr
*Assistant Examiner*—Kimberly L. Asher
*Attorney, Agent, or Firm*—Leon Gilden

[57] ABSTRACT

A swim mask includes a tubular conduit defining a framework about a visor for the mask structure, with the framework further including a right and left snorkel tube mounted to the framework extending upwardly thereof, with the snorkel tubes through the framework arranged for pneumatic communication with a mouthpiece mounted to a lower distal end of the framework at an intersection of the right and left lower conduits of the framework. A modification of the invention includes a seal conduit coextensive with the mask framework to enhance sealing of the mask relative to the individual mounted to a rear surface of the mask conduit.

3 Claims, 4 Drawing Sheets

SWIM MASK AND SNORKEL APPARATUS

BACKGROUND OF THE INVENTION

1. Field of the Invention

The field of invention relates to swim mask apparatus, and more particularly pertains to a new and improved swim mask apparatus wherein the same is arranged to permit simultaneous snorkeling in association with a swim mask in a unitary construction.

2. Description of the Prior Art

Snorkels and swim masks of various types are utilized throughout the prior art to enhance ease of access to below a water surface in a swimming and snorkeling procedure. Such apparatus is exemplified in U.S. Pat. No. 4,879,995 to Christianson setting forth a snorkel device for a swimmer, and similarly such structure of various types as illustrated in the U.S. Pat. No. 4,805,610 to Hunt.

A face mask in U.S. Pat. No. 4,896,380 to Camitani sets forth and organization utilizing built-in ear plugs.

As such, it may be appreciated that there continues to be a need for a new and improved swim mask apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of swim mask apparatus now present in the prior art, the present invention provides a swim mask apparatus wherein the same is arranged to include unitary snorkeling structure in association with a swim mask. As such, the general purpose of the present invention, which will be described subsequently in greater detail, is to provide a new and improved swim mask apparatus which has all the advantages of the prior art swim mask apparatus and none of the disadvantages.

To attain this, the present invention provides a swim mask including a tubular conduit defining a framework about a visor for the mask structure, with the framework further including a right and left snorkel tube mounted to the framework extending upwardly thereof, with the snorkel tubes through the framework arranged for pneumatic communication with a mouthpiece mounted to a lower distal end of the framework at an intersection of the right and left lower conduits of the framework. A modification of the invention includes a seal conduit coextensive with the mask framework to enhance sealing of the mask relative to the individual mounted to a rear surface of the mask conduit.

My invention resides not in any of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved swim mask apparatus which has all the advantages of the prior art swim mask apparatus and none of the disadvantages.

It is another object of the present invention to provide a new and improved swim mask apparatus which may be easily and efficiently manufactured and marketed.

It is a further object of the present invention to provide a new and improved swim mask apparatus which is of a durable and reliable construction.

An even further object of the present invention is to provide a new and improved swim mask apparatus which is susceptible of a low cost of manufacture with regard to both materials and labor, and which accordingly is then susceptible of low prices of sale to the consuming public, thereby making such swim mask apparatus economically available to the buying public.

Still yet another object of the present invention is to provide a new and improved swim mask apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
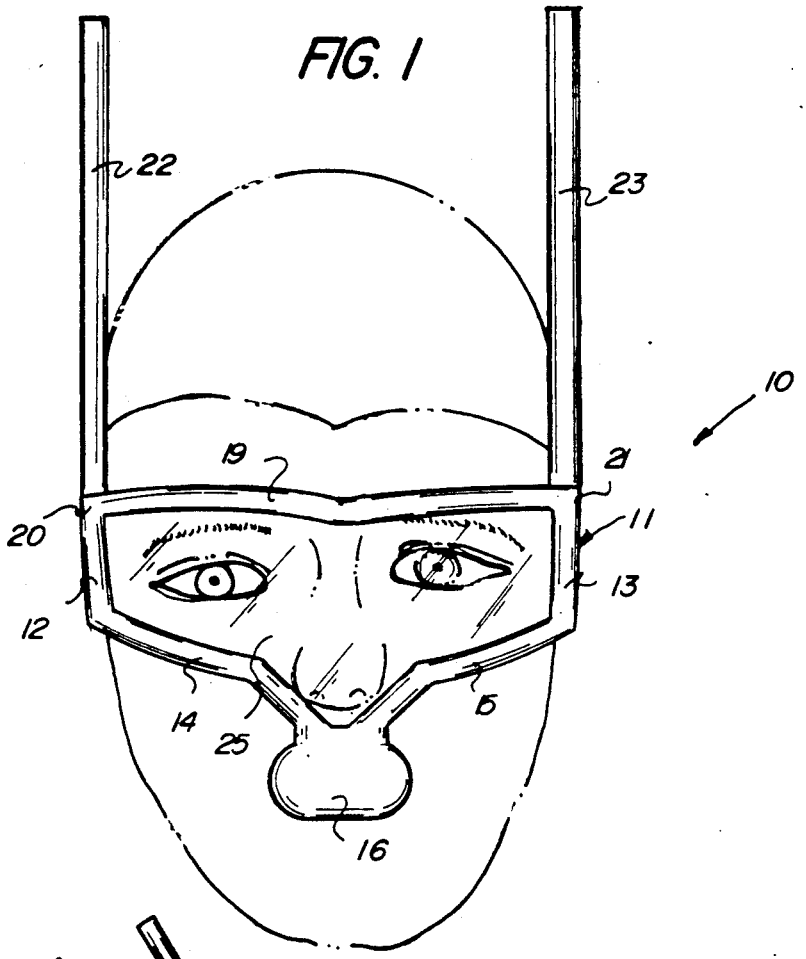
FIG. 1 is an orthographic front view of the invention.
Figure 2:
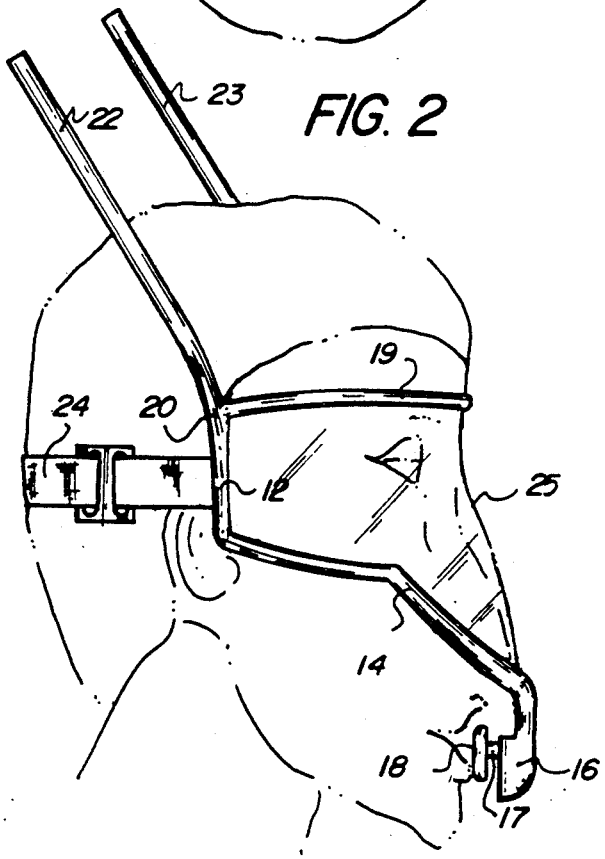
FIG. 2 is an orthographic side view of the instant invention.
Figure 3:
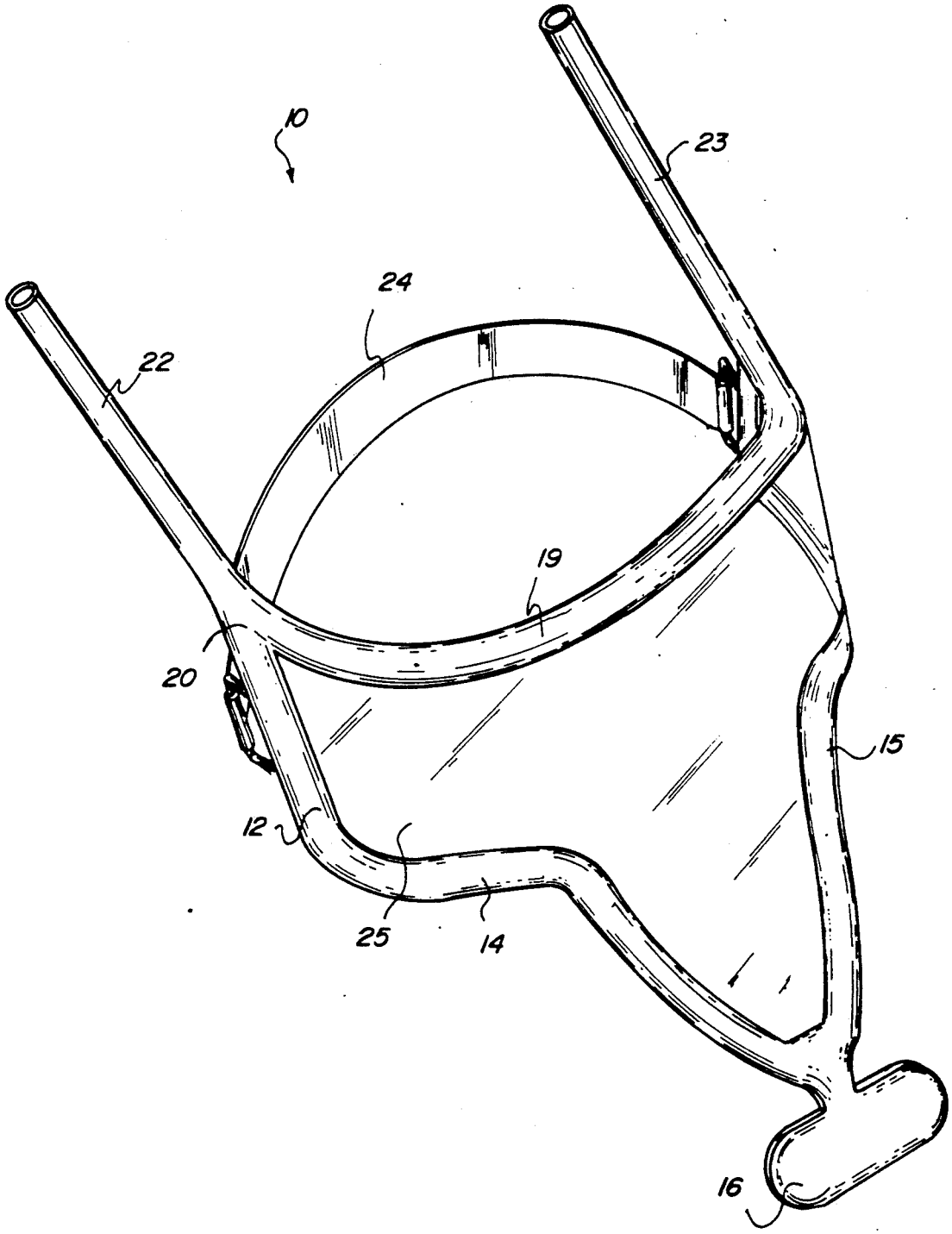
FIG. 3 is an isometric illustration of the instant invention.
Figure 4:
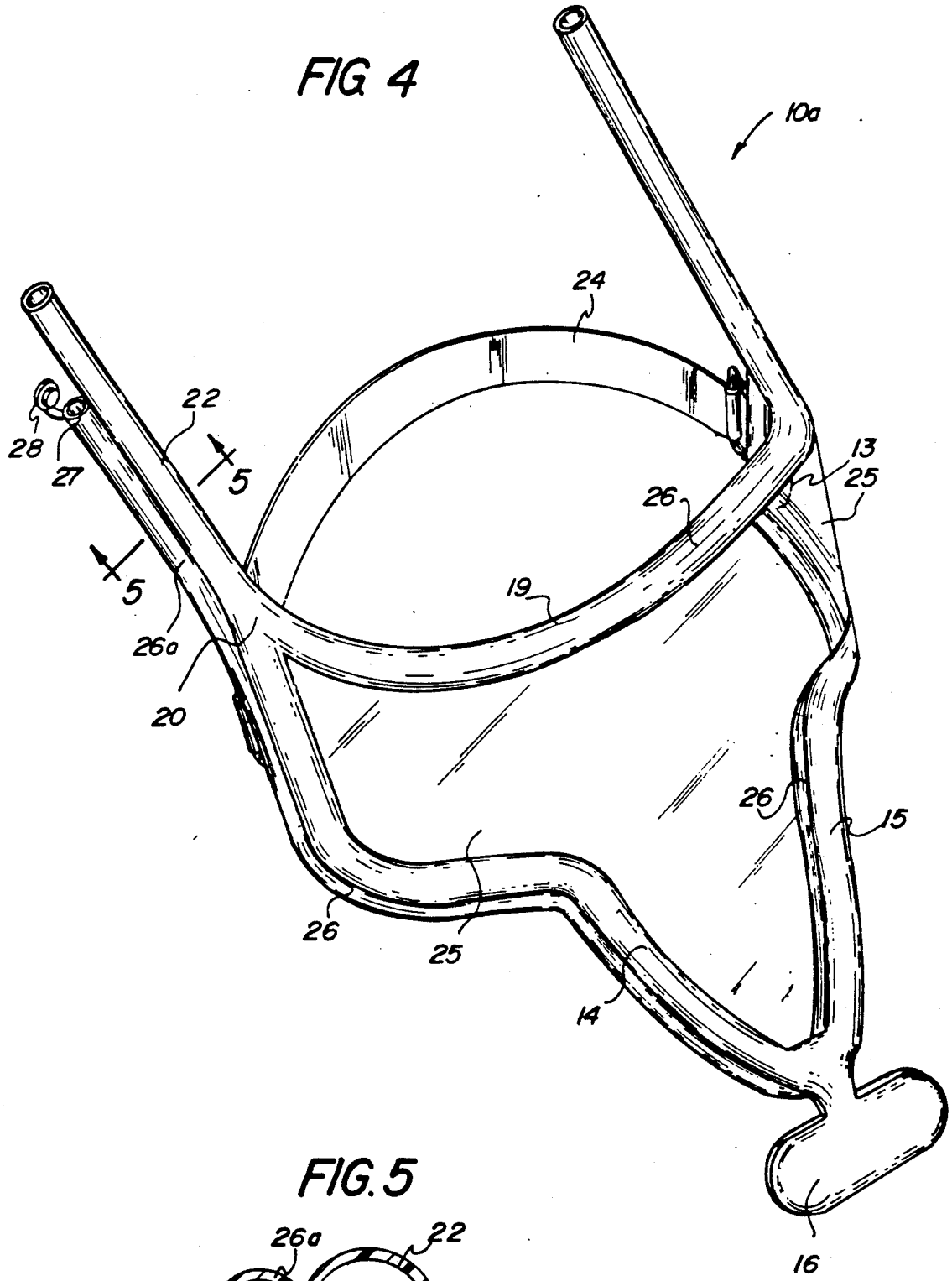
FIG. 4 is an isometric illustration of a modification of the invention.
Figure 5:
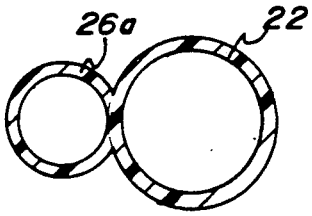
FIG. 5 is an orthographic view, taken along the lines 5—5 of FIG. 4 in the direction indicated by the arrows.
Figure 6:
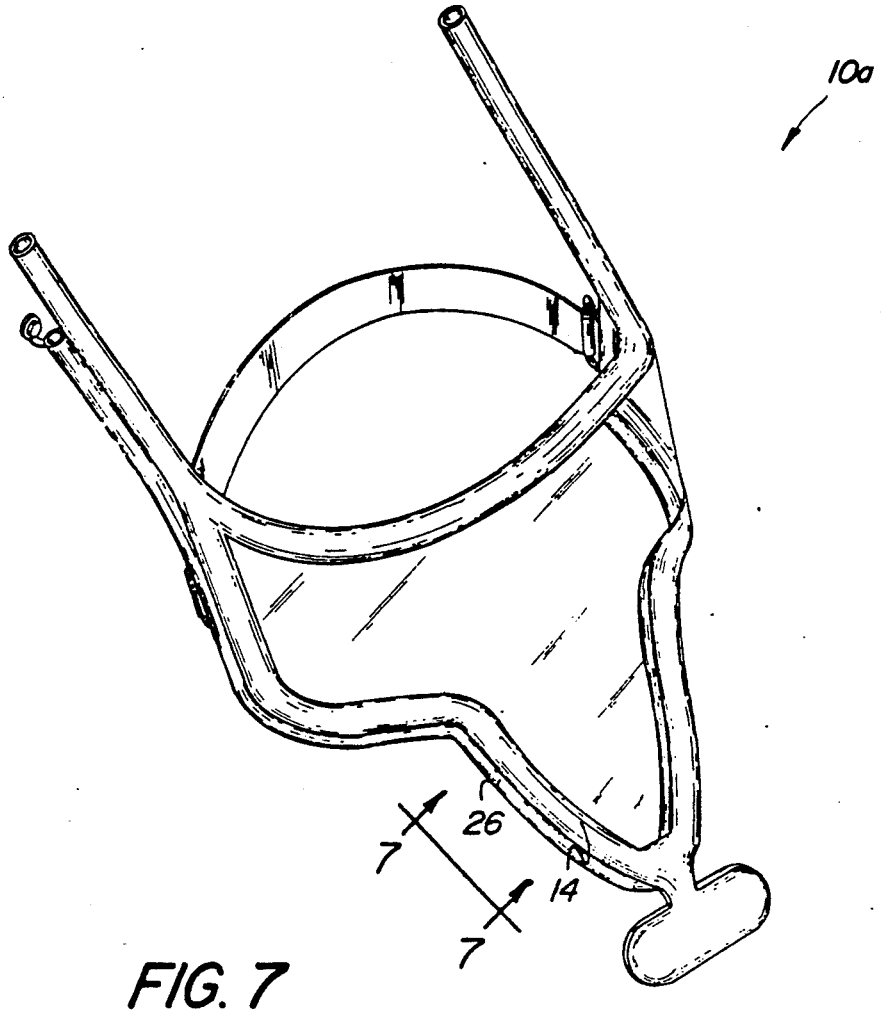
FIG. 6 is an isometric illustration of a further modification of the sealing conduit structure of the invention.
Figure 7:
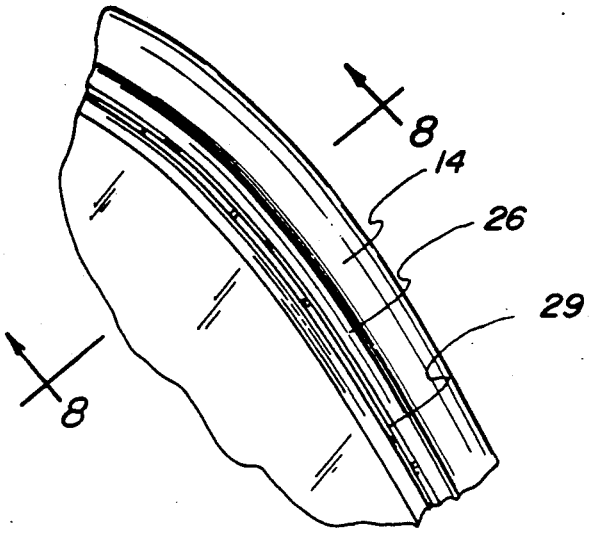
FIG. 7 is an orthographic view, taken along the lines 7—7 of FIG. 6 in the direction indicated by the arrows.
Figure 8:
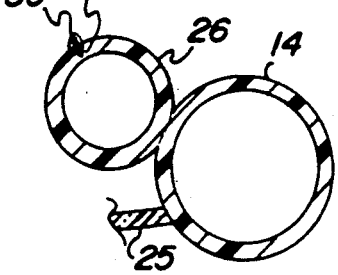
FIG. 8 is an orthographic view, taken along the lines 8—8 of FIG. 7 in the direction indicated by the arrows.

With reference now to the drawings, and in particular to FIGS. 1 to 8 thereof, a new and improved swim mask apparatus embodying the principles and concepts of the present invention and generally designated by the reference numerals 10 and 10*a* will be described.

More specifically, the swim mask apparatus 10 of the invention essentially comprises a tubular visor conduit frame 11, including a right temple conduit 12 spaced from a left temple conduit 13. The right temple conduit 12 at its lower distal end is in pneumatic communication with a right lower conduit 14, with a lower distal end of the left temple conduit 13 in pneumatic communication with a left lower conduit 15. The right and left lower conduits 14 and 15 merge together into an air manifold 16 at lower distal ends of the right and left lower conduits 14 and 15. The air manifold 16 includes an air manifold conduit 17 directed rearwardly of the air manifold 16 terminating in a mouthpiece head 18 spaced from the air manifold 16 to permit an individual to orally grasp the mouthpiece head 18 for pneumatic communication through the right and left conduits 14 and 15. A forehead conduit 19 joins upper distal ends of the respective right and left temple conduits 12 and 13. A right snorkel tube 22 extends upwardly of the right temple conduit 12, with a left snorkel tube 23 extending upwardly of the left temple conduit 13. The right temple conduit 12, the forehead conduit 19, and a lower distal end of the right snorkel tube 22 merge at a right junction 20, wherein a left junction 21 is defined by an intersection of the left snorkel tube 23, the upper distal end of the left temple conduit 13 and a left distal end of the forehead conduit 19. As illustrated, the right and left snorkel tubes 22 and 23 extend upwardly and above the forehead conduit 19 permitting an individual to descend below a water surface level while simultaneously permitting breathing through the mask structure. A transparent visor 25 is contained coextensively within the conduit frame 11 and wherein an adjustable strap member 24, either elastomeric or of adjustable webbing, is provided and mounted medially of the right and left temple conduits 12 and 13 for securement about a head portion of an individual.

A modified aspect of the invention 10*a* is illustrated in the FIGS. 5–8 wherein a sealing pressurized conduit 26 is mounted coextensively to a rear surface of the visor conduit frame 11, wherein the sealing conduit 26 is arranged coextensively relative to a bottom surface of the conduit frame 11, with an extension leg 26*a* extending along a rear surface of the right snorkel tube and an inflation opening 27 plug selectively with a cap 28. A "V" shaped groove 29 is formed within the sealing conduit 26 coextensively therethroughout substantially diametrically opposed to the visor frame 11 receiving a viscous gel sealer 30 therewithin to enhance sealing of the organization relative to an individual's face.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A swim mask apparatus, comprising, a visor conduit frame, the conduit frame including a right temple conduit spaced from a left temple conduit, and a right lower conduit and a left lower conduit, an upper distal end of the right lower conduit mounted to a lower distal end of the right temple conduit, and an upper distal end of the left lower conduit mounted to a lower distal end of the left temple conduit, wherein the right lower conduit and the left lower conduit merge into an air manifold, and a forehead conduit joined to an upper distal end of the right temple conduit and an upper distal end of the left temple conduit at opposed right and left distal ends of the temple conduit, with the temple conduit, the right temple conduit, the left temple conduit, the right lower conduit, the left lower conduit, and the air manifold in pneumatic communication, and a right snorkel tube in pneumatic communication with a first intersection of the forehead conduit and the right temple conduit, and a left snorkel tube in pneumatic communication with a second junction defined by an intersection of the forehead conduit and the left temple conduit, wherein the right snorkel tube and the left snorkel tube extend upwardly above the forehead conduit, and an adjustable strap member secured to the right temple conduit and the left temple conduit for securement of the visor conduit frame to an individual, and a transparent visor contained coextensively within the visor conduit frame.

2. An apparatus as set forth in claim 1 including a sealing conduit mounted to a rear surface of the visor conduit rearwardly and spaced from the visor, and wherein the sealing conduit includes a sealing conduit extension leg extending along a rear surface of the right snorkel tube terminating in an inflation opening, and an inflation cap mounted adjacent the inflation opening to effect sealing of the inflation opening and the sealing conduit upon pressurizing the sealing conduit to enhance sealing to an individual.

3. An apparatus as set forth in claim 2 including a "V" shaped groove coextensively directed throughout the sealing conduit substantially diametrically opposed relative to the visor conduit frame, and a sealer fluid contained within the "V" shaped groove to enhance sealing relative to an individual.

* * * * *